US009700123B1

(12) United States Patent
Pinholster, Jr. et al.

(10) Patent No.: US 9,700,123 B1
(45) Date of Patent: Jul. 11, 2017

(54) MULTI-PERSON HAMMOCK ASSEMBLY, SELF-STANDING HAMMOCK FRAME, AND METHOD FOR SUSPENDING A PLURALITY OF FLEXIBLE HAMMOCKS

(71) Applicant: Eagles Nest Outfitters, Inc., Asheville, NC (US)

(72) Inventors: Peter G. Pinholster, Jr., Asheville, NC (US); Elisha Halsey Brinton, Asheville, NC (US)

(73) Assignee: Eagles Nest Outfitters, Inc., Asheville, NC (US)

( * ) Notice: Subject to any disclaimer, the term of this patent is extended or adjusted under 35 U.S.C. 154(b) by 0 days.

(21) Appl. No.: 14/195,060

(22) Filed: Mar. 3, 2014

Related U.S. Application Data

(60) Provisional application No. 61/793,667, filed on Mar. 15, 2013.

(51) Int. Cl.
*A45F 3/22* (2006.01)
*A45F 3/24* (2006.01)

(52) U.S. Cl.
CPC ..... *A45F 3/24* (2013.01)

(58) Field of Classification Search
CPC ..... A45F 3/22; A45F 3/24
USPC ..... 5/120, 123, 127, 129, 130
See application file for complete search history.

(56) References Cited

U.S. PATENT DOCUMENTS

| | | | | |
|---|---|---|---|---|
| 935,445 | A * | 9/1909 | McClennen | 5/129 |
| 1,071,541 | A * | 8/1913 | Young | 5/129 |
| 1,268,113 | A * | 6/1918 | Gosso | 5/113 |
| 1,456,031 | A * | 5/1923 | Molby | 482/131 |
| 5,224,225 | A * | 7/1993 | Singleton et al. | 5/127 |
| 5,636,392 | A * | 6/1997 | Choi | 5/127 |
| 6,360,383 | B1 * | 3/2002 | Tseng | 5/129 |
| 6,842,920 | B1 * | 1/2005 | Branch, III | 5/128 |
| 7,243,383 | B1 * | 7/2007 | Hennessy | 5/127 |
| 7,316,239 | B2 * | 1/2008 | Yang | 135/137 |
| 7,627,913 | B2 * | 12/2009 | Clark | 5/120 |
| 8,567,424 | B2 * | 10/2013 | Hill, Sr. | 135/125 |
| 2004/0049848 | A1 * | 3/2004 | Boyd | 5/120 |

OTHER PUBLICATIONS

Trinity Hammocks, Trinity Hammocks-Assembly video of model Infinity, Sep. 17, 2012, Vimeo, vimeo.com/49508751.*
Derek, 3-Person Hammock Stand, Apr. 2, 2013, The Ultimate Hang, theultimatehang.com/2013/04/3-person-hamock-stand/.*

* cited by examiner

*Primary Examiner* — Nicholas Polito
*Assistant Examiner* — Ifeolu Adeboyejo
(74) *Attorney, Agent, or Firm* — Schwartz Law Firm, P.C.

(57) ABSTRACT

A self-standing hammock frame has three spaced apart hammock suspension points. The hammock frame comprises first, second, and third leg assemblies. The first leg assembly has raised ends located at respective first and second hammock suspension points. The second leg assembly is joined to the first leg assembly, and has raised ends located at respective second and third hammock suspension points. The third leg assembly is joined to the first and second leg assemblies, and has raised ends located at respective first and third hammock suspension points. The first, second, and third leg assemblies cooperate to form a closed-end hammock support structure.

11 Claims, 6 Drawing Sheets

MULTI-PERSON HAMMOCK ASSEMBLY, SELF-STANDING HAMMOCK FRAME, AND METHOD FOR SUSPENDING A PLURALITY OF FLEXIBLE HAMMOCKS

TECHNICAL FIELD AND BACKGROUND OF THE INVENTION

This invention relates broadly and generally to a multi-person hammock assembly, self-standing hammock frame, and method for suspending a plurality of flexible hammocks in a self-standing hammock frame.

SUMMARY OF EXEMPLARY EMBODIMENTS

Various exemplary embodiments of the present invention are described below. Use of the term "exemplary" means illustrative or by way of example only, and any reference herein to "the invention" is not intended to restrict or limit the invention to exact features or steps of any one or more of the exemplary embodiments disclosed in the present specification. References to "exemplary embodiment," "one embodiment," "an embodiment," "various embodiments," and the like, may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

It is also noted that terms like "preferably", "commonly", and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention.

According to one exemplary embodiment, the present disclosure comprises a self-standing hammock frame having three spaced apart hammock suspension points. The hammock frame comprises first, second, and third leg assemblies. The first leg assembly has raised ends located at respective first and second hammock suspension points. The second leg assembly is joined to the first leg assembly, and has raised ends located at respective second and third hammock suspension points. The third leg assembly is joined to the first and second leg assemblies, and has raised ends located at respective first and third hammock suspension points. The first, second, and third leg assemblies cooperate to form a closed-end support structure.

According to another exemplary embodiment, each leg assembly comprises multiple leg sections frictionally connected together at respective proximal ends.

According to another exemplary embodiment, each of the multiple leg sections is curved, and assembled in a substantially concave arc from one raised end to the other.

According to another exemplary embodiment, an elongated cross-brace is attached to adjacent leg assemblies proximate their respective joined raised ends.

According to another exemplary embodiment, three enlarged suspension heads are located at respective suspension points.

According to another exemplary embodiment, each suspension head comprises matching first and second fastener plates integrally formed with respective joined raised ends of adjacent leg assemblies.

According to another exemplary embodiment, the first and second fastener plates comprise respective flat contacting surfaces defining aligned fastener holes.

According to another exemplary embodiment, each suspension head further defines a line attachment hole.

According to another exemplary embodiment, the suspension heads are equally spaced apart from a notional center point of the hammock frame.

According to another exemplary embodiment, the suspension heads are equally spaced apart from each other relative to a notional center point of the hammock frame.

In another exemplary embodiment, the present disclosure comprises a multi-person hammock assembly. The hammock assembly comprises a self-standing hammock frame having three spaced apart hammock suspension points. The hammock frame comprises first, second, and third leg assemblies. The first leg assembly has raised ends located at respective first and second hammock suspension points. The second leg assembly is joined to the first leg assembly, and has raised ends located at respective second and third hammock suspension points. The third leg assembly is joined to the first and second leg assemblies, and has raised ends located at respective first and third hammock suspension points. The first, second, and third leg assemblies cooperate to form a closed-end support structure. A first flexible hammock extends between the first and second suspension points. A second flexible hammock extends between the second and third suspension points. A third flexible hammock extends between the first and third suspension points.

The term "hammock" is defined broadly herein to mean any structure (e.g., sling-style) made of made of fabric, rope, netting, or other material capable of being suspended between two points, and used for swinging, sleeping, resting, or other desired purpose.

In yet another exemplary embodiment, the present disclosure comprises a method for suspending a plurality of flexible hammocks in a self-standing hammock frame. The hammock frame comprises three joined leg assemblies and three spaced apart suspension points. The leg assemblies cooperate to form a closed-end hammock support structure. The method comprising extending a first flexible hammock between the first and second suspension points of the hammock frame. A second flexible hammock is extended between the second and third suspension points of the hammock frame. A third flexible hammock is extended between the first and third suspension points of the hammock frame.

BRIEF DESCRIPTION OF THE DRAWINGS

Exemplary embodiments of the present invention will hereinafter be described in conjunction with the following drawing figures, wherein like numerals denote like elements, and wherein.

DESCRIPTION OF EXEMPLARY EMBODIMENTS AND BEST MODE

The present invention is described more fully hereinafter with reference to the accompanying drawings, in which one or more exemplary embodiments of the invention are shown. Like numbers used herein refer to like elements throughout. This invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limiting as to the scope of the invention, which is to be given the full breadth of the appended claims and any and all equivalents thereof. Moreover, many embodiments, such as adaptations, variations, modifications, and equivalent arrangements, will be implicitly disclosed by the embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has been previously reduced to practice or that any testing has been performed. Likewise, unless stated otherwise, use of verbs in the past tense (present perfect or preterit) is not intended to indicate or imply that the invention has been previously reduced to practice or that any testing has been performed.

Figure 1:
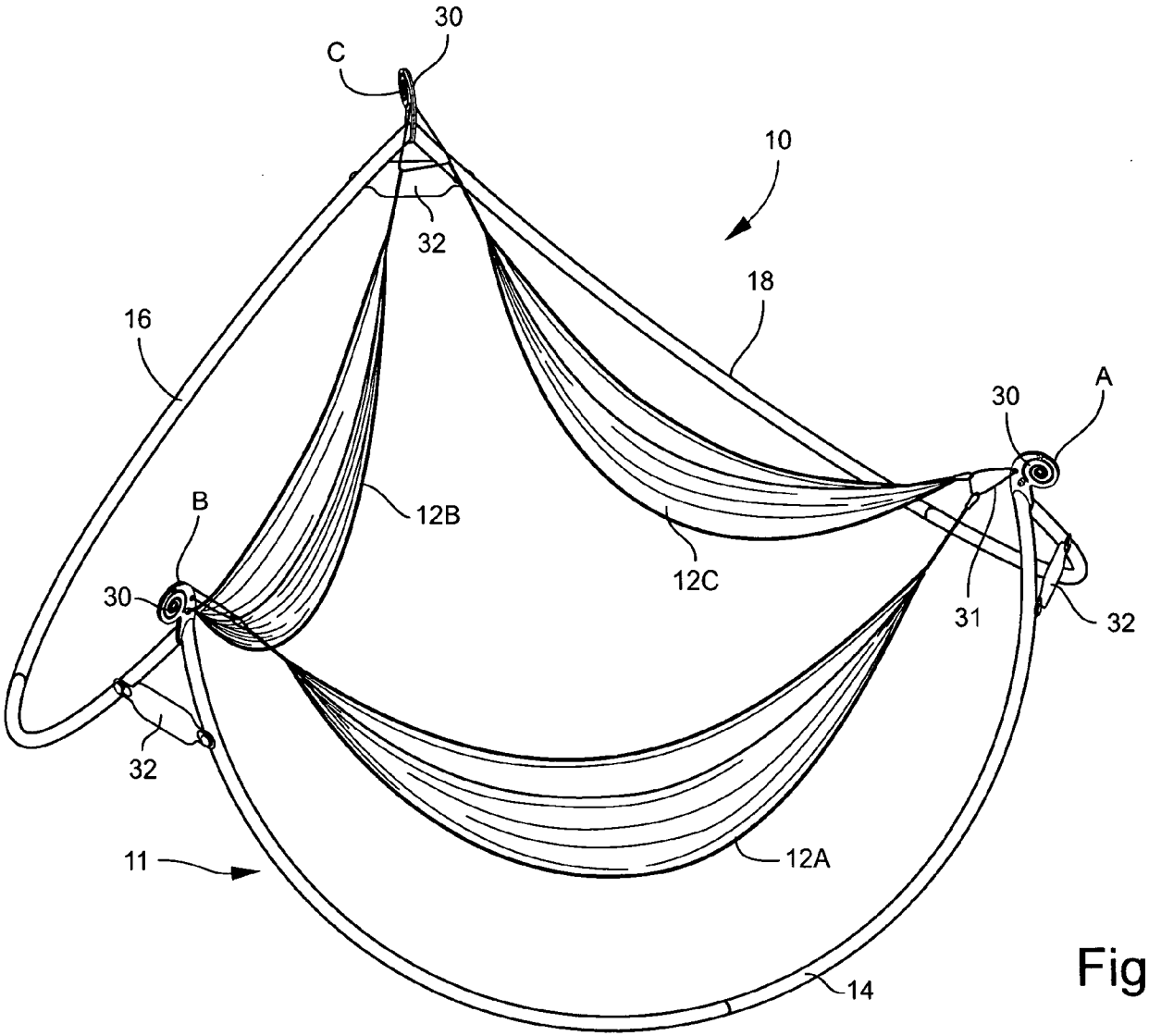
FIG. 1 is a perspective view of a multi-person hammock assembly according to one exemplary embodiment of the present disclosure.
Figure 2:
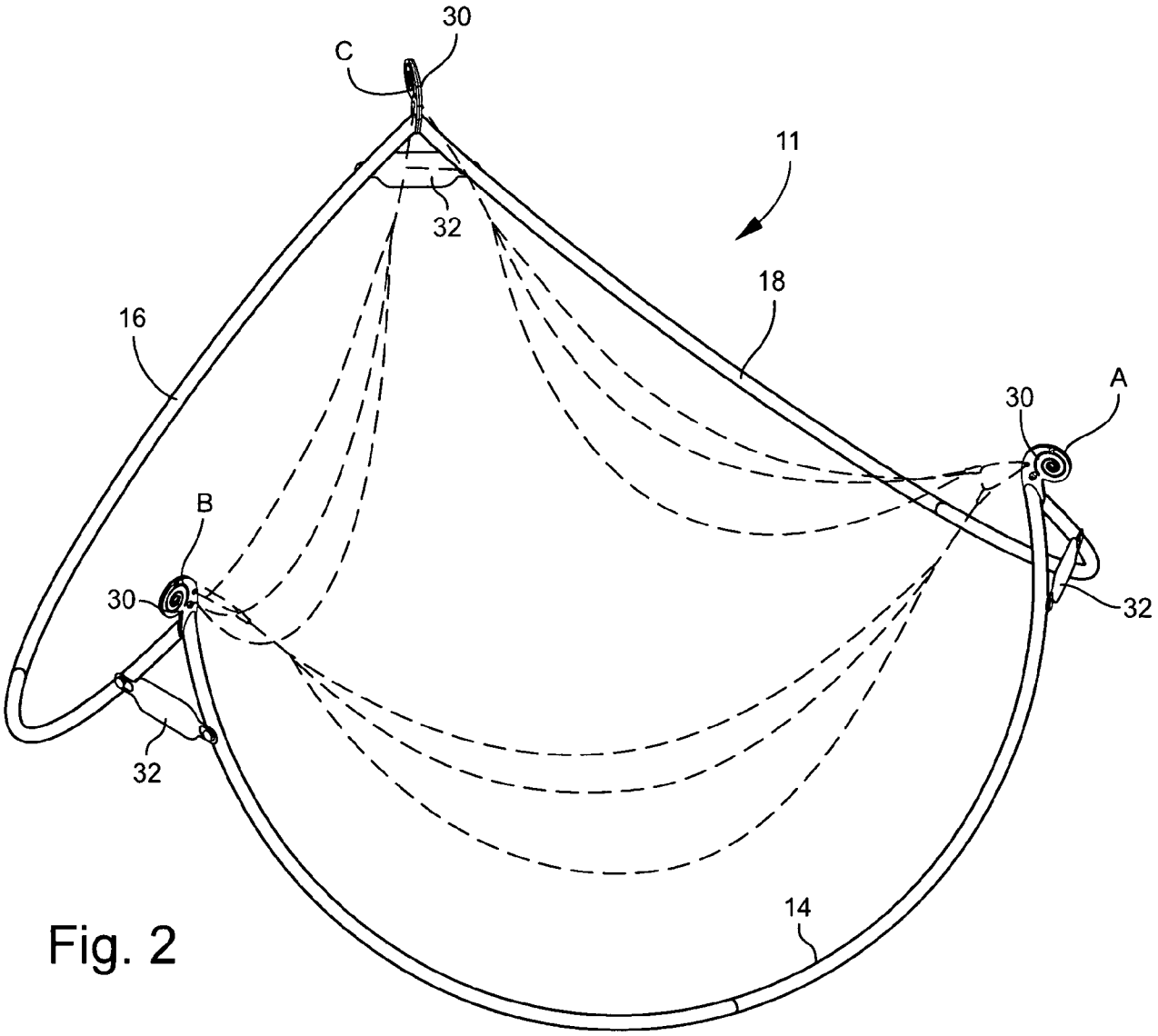
FIG. 2 is a perspective view of an exemplary self-standing hammock frame in the present hammock assembly.

Referring now specifically to the drawings, a multi-person hammock assembly according to one exemplary embodiment of the present disclosure is illustrated in FIG. 1 and shown broadly at reference numeral 10. The exemplary hammock assembly 10 incorporates a self-standing hammock frame 11, shown in FIGS. 1-4, comprising three spaced apart hammock suspension points (A, B, and C) designed for hanging up to three flexible hammocks 12A, 12B, and 12C. The hammocks 12A-12C may comprise any conventional sling-style hammock, with or without spreader bars, and made of fabric, rope, or netting, or other breathable material. The exemplary hammock frame 11 incorporates identical first, second, and third leg assemblies 14, 16, and 18. The first leg assembly 14 has raised ends located at respective first and second hammock suspension points A and B. The second leg assembly 16 is joined to the first leg assembly 14, and has raised ends located at respective second and third hammock suspension points B and C. The third leg assembly 18 is joined to the first and second leg assemblies 14, 16, and has raised ends located at respective first and third hammock suspension points A and C. As shown in FIG. 1, a first flexible hammock 12A extends between the first and second suspension points A and B. A second flexible hammock 12B extends between the second and third suspension points B and C. A third flexible hammock 12C extends between the first and third suspension points A and C.

Figure 5:
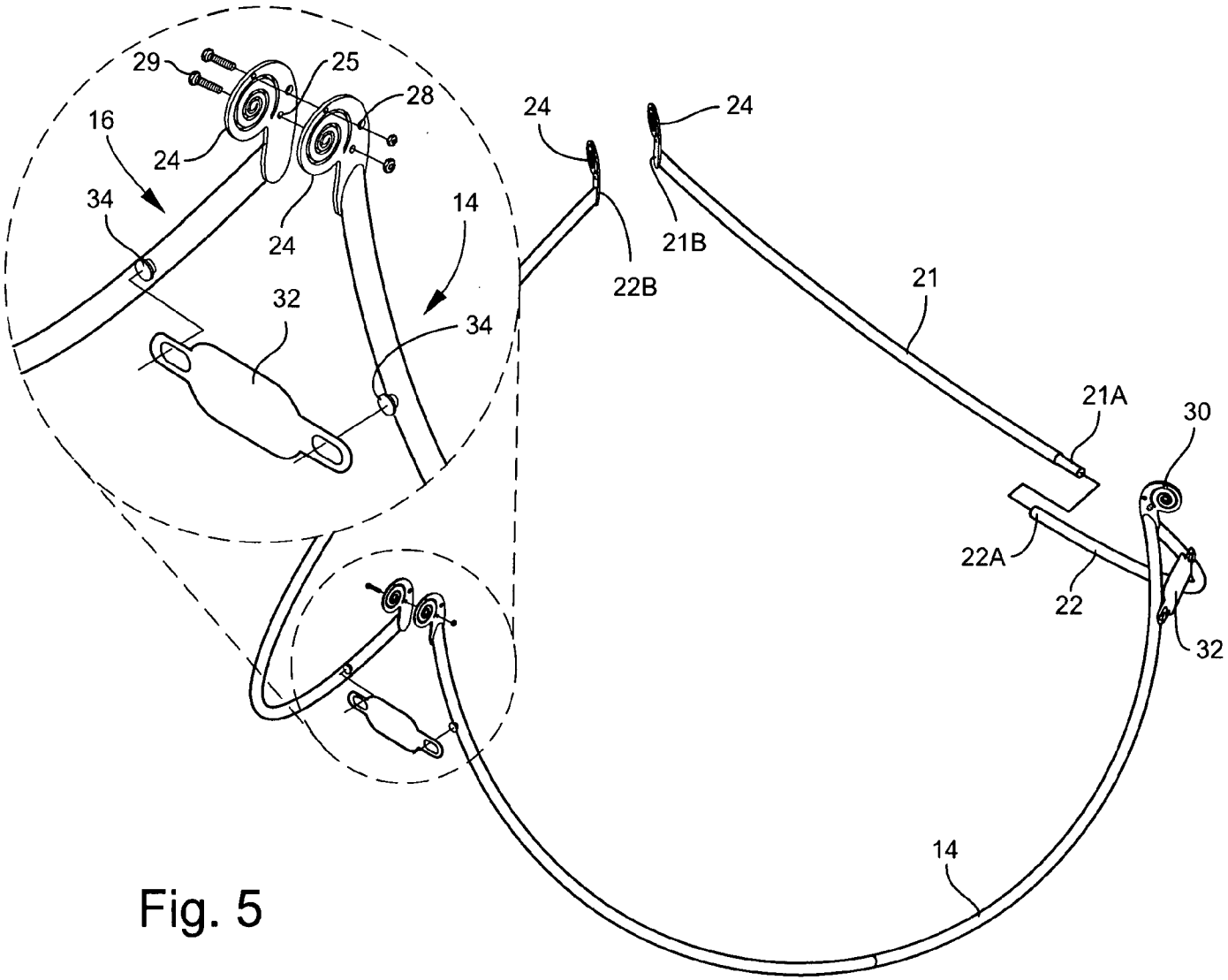
FIG. 5 is a perspective view of the exemplary hammock frame with certain components exploded to illustrate their assembly.
Figure 6:
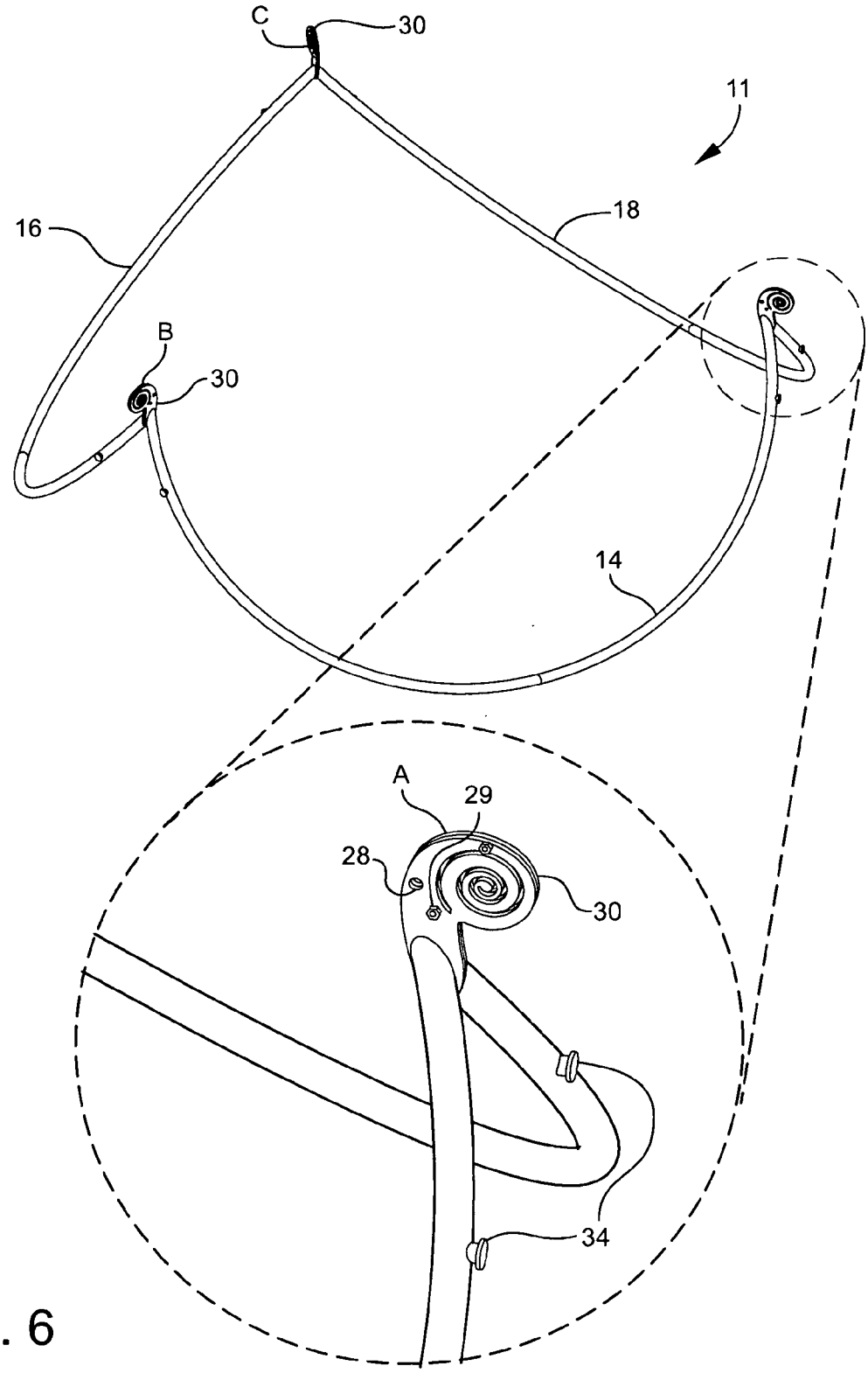
FIG. 6 is a further perspective view of the exemplary hammock frame with one of the three decorative suspension heads enlarged for clarity.

Referring to FIGS. 5 and 6, each of the leg assemblies 14, 16, and 18 comprises curved sections 21 and 22 fabricated of 2-inch metal tubing and frictionally joined together at respective male and female proximal ends 21A, 22A. The joined leg sections 21, 22 cooperate to form a substantially concave arc (or half-circle) from one raised end of the leg assembly 14, 16, 18 to the other.

A fastener plate 24 is integrally formed at the distal end 21B, 22B of each leg section 21, 22, and defines one or more bolt holes 25 and a line attachment hole 28. When erecting the hammock frame 11, matching fastener plates 24 of adjacent leg assemblies 14, 16, 18 are brought together and bolt fasteners 29 (or other suitable hardware) inserted through the aligned bolt holes 25 to join the leg assemblies 14, 16, 18 together. In the exemplary embodiment, the matching fastener plates 24 cooperate to form an enlarged decorative suspension head 30 at each of the three suspension points A, B, and C (FIGS. 1-4). Non-stretch hammock suspension lines 31, shown in FIG. 1, are inserted through the line attachment holes 28 formed with the suspension heads 30, and function to attach the hammocks 12A-12C at an optimal angle of about 30 degrees.

As best shown in FIGS. 1, 2, 5 and 6, for added support and stability, elongated non-stretch cross-braces 32 may be attached to adjacent leg assemblies 14, 16, 18 proximate the decorative suspension heads 30. Each leg assembly 14, 16, 18 has a fixed projecting brace head 34 designed to receive an end opening 35 formed with the cross-brace 32. The cross-braces 32 attach to brace heads 34 of adjacent leg assemblies 14, 16, 18, and serve to prevent the hammock frame 11 from spreading outwardly and collapsing under the weight of the users.

Figure 3:
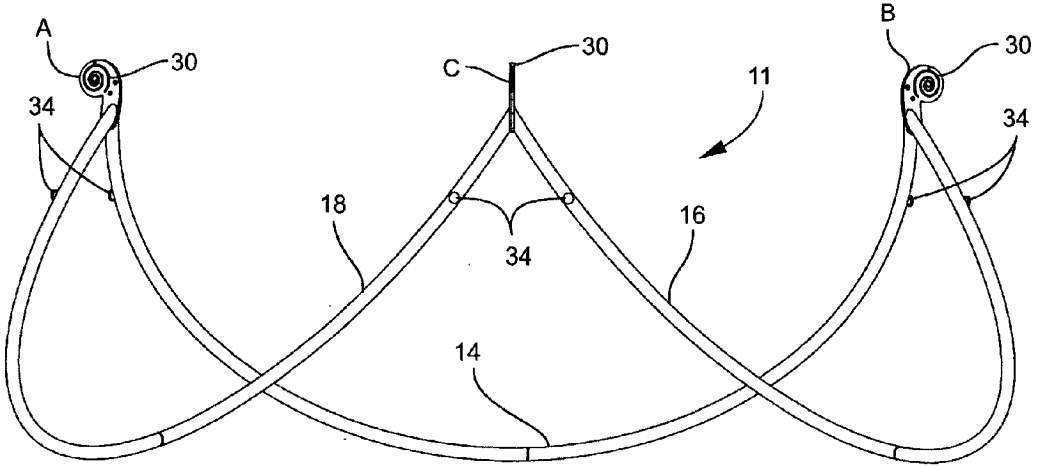
FIGS. 3 and 4 are side views of the exemplary hammock frame.
Figure 4:
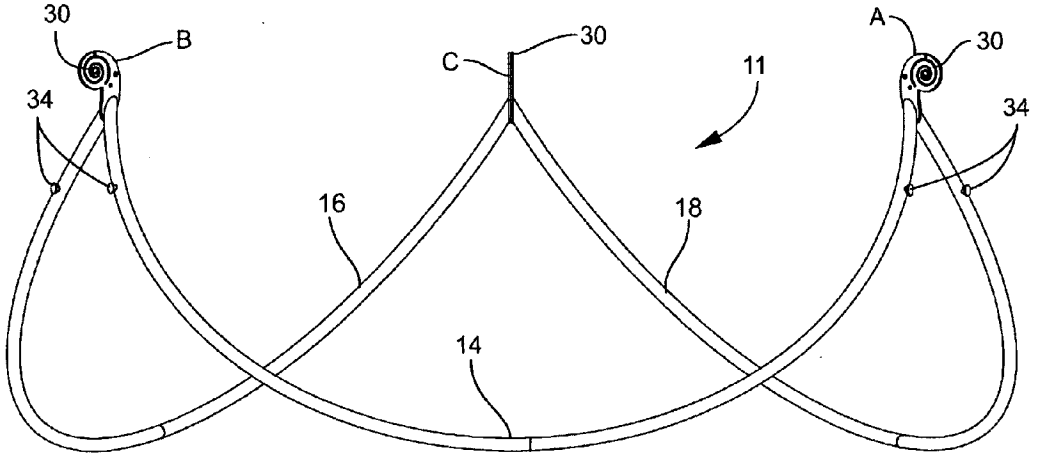

Referring to FIGS. 3 and 4, in the exemplary hammock frame 11 each cross-brace is located a distance "D" of about 10 inches beneath the joined distal ends of adjacent leg assemblies 14, 16, 18. The cross-braces maintain the angle "a" between adjacent leg assemblies 14, 16, 18 at approximately 60 to 70 degrees; and more particularly, 64 degrees. The exemplary cross-braces 32 may be fabricated of metal, vinyl, or non-stretch fabric, such as nylon or the like. In alternative embodiments, the joint at each hammock suspension point A, B, and C may be secured by any other suitable hardware or other means including a triangular metal web (or gusset) welded to one or both of the adjacent leg assemblies.

Figure 7:
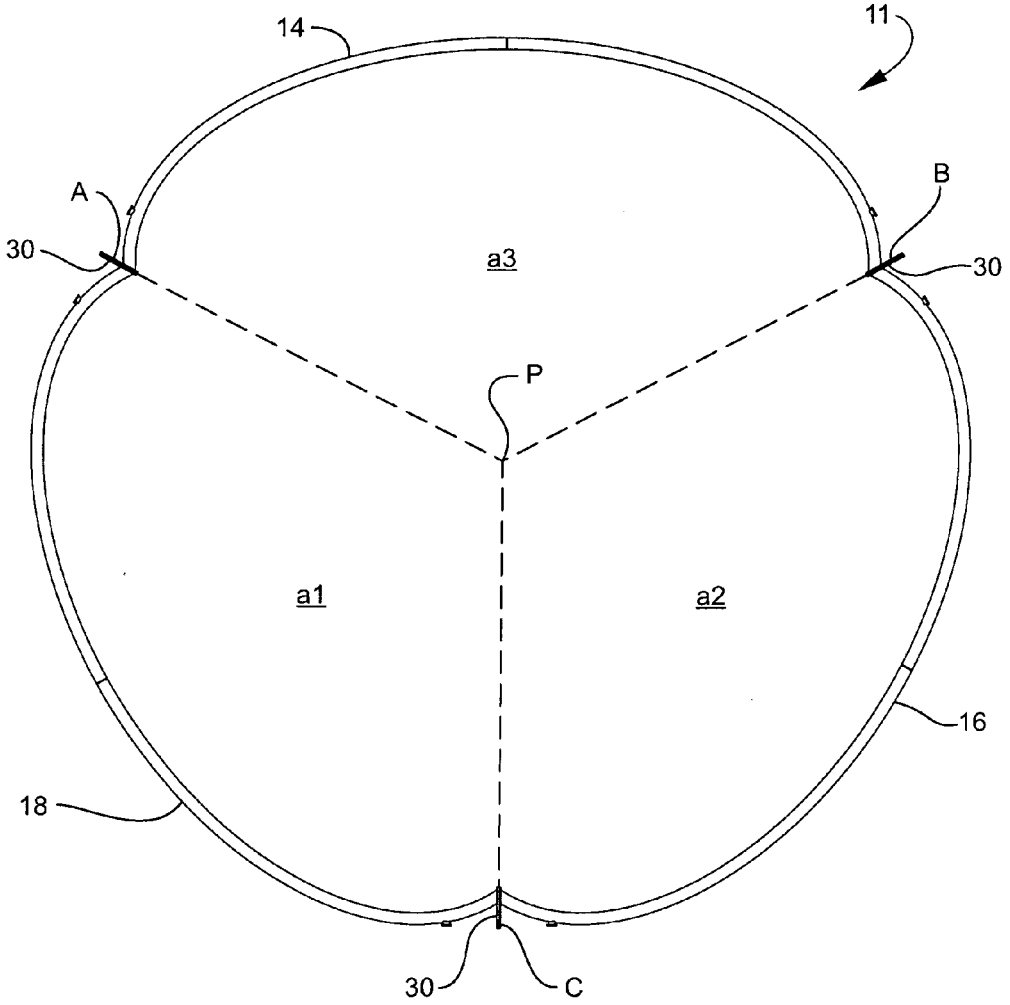
FIG. 7 is a plan view of the exemplary hammock frame.

As best shown in FIG. 7, the first, second, and third leg assemblies 14, 16, and 18 of the hammock frame 11 cooperate to form a closed-end symmetrical support structure. In the exemplary embodiment, the suspension heads 30 are equally spaced apart from each other and from a notional center point (P) of the hammock frame 11. The exemplary hammock frame 11 is divided into thirds, such that each section occupies a notional area (a1, a2, a3) of approximately 120 degrees. The radius of curvature R of each leg assembly is in a range of about 5 feet to 6 feet; and more specifically, about 5 feet, 10 inches. The curvature is substantially continuous and uniform from one raised end of the leg assembly 14, 16, 18 to the other.

In alternative exemplary embodiments not shown, the self-standing hammock frame may comprise multiple leg assemblies formed of straight tubing segments with angular joint pieces. The hammock frame may also comprise slip joints or hinges for convenient folding, assembly/disassembly, and transport. The leg assemblies may be fabricated from a variety of materials including, but not limited to, wood, steel, aluminum, fiberglass, and carbon fiber. Multiple frames can be placed in geometrical patterns at events to create a visually striking presence. While the present exemplary frame holds up to 3 hammocks in a triangular formation, other embodiments of the disclosure may carry 4 or more hammocks and may incorporate 4 or more suspension points.

For the purposes of describing and defining the present invention it is noted that the use of relative terms, such as "substantially", "generally", "approximately", and the like, are utilized herein to represent an inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

Exemplary embodiments of the present invention are described above. No element, act, or instruction used in this description should be construed as important, necessary, critical, or essential to the invention unless explicitly described as such. Although only a few of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention as defined in the appended claims.

In the claims, any means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Unless the exact language "means for" (performing a particular function or step) is recited in the claims, a construction under §112, 6th paragraph is not intended. Additionally, it is not intended that the scope of patent protection afforded the present invention be defined by reading into any claim a limitation found herein that does not explicitly appear in the claim itself.

What is claimed is:

1. A self-standing hammock frame comprising three spaced apart hammock suspension points, said hammock frame comprising:

a first leg assembly having raised terminal ends located at respective first and second hammock suspension points;

a second leg assembly joined to said first leg assembly, and having raised terminal ends located at respective second and third hammock suspension points, wherein adjacent terminal ends of said first and second leg assemblies converge and join at said second hammock suspension point;

a third leg assembly joined to said first and second leg assemblies, and having raised terminal ends located at respective first and third hammock suspension points, wherein adjacent terminal ends of said first and third leg assemblies converge and join at said first hammock suspension point, and wherein adjacent terminal ends of said second and third leg assemblies converge and join at said third hammock suspension point, whereby said first, second, and third leg assemblies cooperate to form a closed-end of hammock support structure; and wherein the raised terminal ends of said first, second, and third leg assemblies comprise respective raised terminal ends of said hammock frame at said first, second, and third hammock suspension points, and wherein each raised terminal end of said hammock frame comprises an enlarged suspension head defining a hammock attachment opening from which one end of a hammock is suspended.

2. The self-standing hammock frame according to claim 1, wherein each leg assembly comprises multiple leg sections frictionally connected together at respective proximal ends.

3. The self-standing hammock frame according to claim 2, wherein each of said multiple leg sections is curved, and assembled in a substantially concave arc from one raised end to the other.

4. The self-standing hammock frame according to claim 1, and comprising an elongated cross-brace attached to adjacent leg assemblies proximate their respective joined raised ends.

5. The self-standing hammock frame according to claim 1, wherein said suspension heads are equally spaced apart from a notional center point of said hammock frame.

6. The self-standing hammock frame according to claim 1, wherein said suspension heads are equally spaced apart from each other relative to a notional center point of said hammock frame.

7. A multi-person hammock assembly comprising:

a self-standing hammock frame comprising three spaced apart hammock suspension points, said hammock frame comprising:

i. a first leg assembly having raised terminal ends located at respective first and second hammock suspension points;

ii. a second leg assembly joined to said first leg assembly, and having raised terminal ends located at respective second and third hammock suspension points, wherein adjacent terminal ends of said first and second leg assemblies converge and join at said second hammock suspension point; and iii. a third leg assembly joined to said first and second leg assemblies, and having raised terminal ends located at respective first and third hammock suspension points, wherein adjacent terminal ends of said first and third leg assemblies converge and join at said first hammock suspension point, and wherein adjacent terminal ends of said second and third leg assemblies converge and join at said third hammock suspension point, whereby said first, second, and third leg assemblies cooperate to form a closed-end of hammock support structure, and wherein the raised terminal ends of said first, second, and third leg assemblies comprise respective raised terminal ends of said hammock frame at said first, second, and third hammock suspension points, and wherein each raised terminal end of said hammock frame comprises an enlarged suspension head defining a hammock attachment opening from which one end of a hammock is suspended;

a first flexible hammock extending between said first and second suspension points, and suspended at respective opposite ends from cooperating enlarged suspension heads of said hammock frame;

a second flexible hammock extending between said second and third suspension points, and suspended at respective opposite ends from cooperating enlarged suspension heads of said hammock frame; and a third flexible hammock extending between said first and third suspension points, and suspended at respective opposite ends from cooperating enlarged suspension heads of said hammock frame.

8. The multi-person hammock assembly according to claim 7, wherein each leg assembly comprises multiple leg sections frictionally connected together at respective proximal ends.

9. The multi-person hammock assembly according to claim 8, wherein each of said multiple leg sections is curved, and assembled in a substantially concave arc from one raised end to the other.

10. The multi-person hammock assembly according to claim 7, and comprising an elongated cross-brace attached to adjacent leg assemblies proximate their respective joined raised ends.

11. The multi-person hammock assembly according to claim 7, wherein said suspension heads are equally spaced apart from each other relative to a notional center point of said hammock frame.

* * * * *